US008098127B2

(12) United States Patent
Tchaplia

(10) Patent No.: US 8,098,127 B2
(45) Date of Patent: Jan. 17, 2012

(54) RESISTOR FOR MICROWAVE APPLICATIONS

(75) Inventor: Ilya Tchaplia, Thornhill (CA)

(73) Assignee: ITS Electronics Inc., Concord (CA)

( * ) Notice: Subject to any disclaimer, the term of this patent is extended or adjusted under 35 U.S.C. 154(b) by 848 days.

(21) Appl. No.: 12/135,276

(22) Filed: Jun. 9, 2008

(65) Prior Publication Data

US 2008/0303627 A1 Dec. 11, 2008

Related U.S. Application Data

(60) Provisional application No. 60/942,538, filed on Jun. 7, 2007.

(51) Int. Cl.
*H01C 1/01* (2006.01)

(52) U.S. Cl. ..... 338/320; 338/334; 338/254; 338/260

(58) Field of Classification Search ..... 338/320, 338/49, 115, 197, 254, 260, 315, 325, 333, 338/334, 307, 309, 327, 332
See application file for complete search history.

(56) References Cited

U.S. PATENT DOCUMENTS

| | | | | | |
|---|---|---|---|---|---|
| 3,582,842 | A * | 6/1971 | Friedman | 333/81 A |
| 3,680,013 | A * | 7/1972 | Pye | 333/81 R |
| 4,450,418 | A * | 5/1984 | Yum et al. | 333/128 |
| 5,831,491 | A * | 11/1998 | Buer et al. | 333/128 |
| 6,097,276 | A * | 8/2000 | Van Den Broek et al. | 338/9 |
| 2004/0080397 | A1 * | 4/2004 | Cubon et al. | 338/307 |
| 2004/0239474 | A1 * | 12/2004 | Dunn et al. | 338/22 R |

* cited by examiner

*Primary Examiner* — Kyung Lee
(74) *Attorney, Agent, or Firm* — Bereskin & Parr LLP/S.E.N.C.R.L., s.r.l.

(57) ABSTRACT

A resistor assembly for use at microwave frequencies, has a substrate with first and second contacts or metalizations at either end of the substrate. A third contact or metallization is provided on one side of the substrate generally in the middle thereof. First and second resistors, as thin film resistors, are provided on the substrate extending between the first and second contacts and the third, central contact. A third resistor is provided on the other side of the substrate, connecting the first and second contacts, so as to form a delta configuration of three resistors. This then provides a resistor configuration that can be used to implement a three port Wilkinson splitter or combiner.

7 Claims, 2 Drawing Sheets

RESISTOR FOR MICROWAVE APPLICATIONS

FIELD

This invention relates to a resistor for microwave applications, and more particularly is concerned with a resistor assembly providing a number of resistors, that can be used at high frequencies.

INTRODUCTION

As in other electronic applications, when working with microwave signals it is commonly required to provide and combine signals for various purposes. For example, in amplifying equipment, it is common to divide and re-combine signals.

Various standard combiners and splitters are known. One common configuration is a Wilkinson splitter, which can also function as a combiner when operated in the opposite direction. A standard Wilkinson splitter has an input port on one side and divides a signal into two at two outlet ports. This is achieved by connecting the input port through each of two quarter wave transformers to the two outlet ports. The two outlet ports are connected together by a resistor whose impedance is the $\sqrt{2}$ times the impedance of each of the quarter wave transformers, and also twice the impedance present at each outlet port.

The various resistances are required in order to ensure that the device has the appropriate characteristics. The quarter wave transformers transform the impedances of either two outlet ports so that when summed, the combined impedance apparent at the input port is the same as the impedance at each outlet port.

When functioning as a power combiner, a single input at one of the output ports is split equally between the input port and the other outlet port. The resistor between the two outlet ports ensures that none of the signal appears at the other outlet port, so that it serves the important function of decoupling the two outlet ports. In effect, half the power is dissipated in the resistor between the outlet ports and the other half is delivered to the input port.

However, there is no simple way to configure a Wilkinson splitter/combiner for multi-stage applications. Proposals have been made for so-called N-way Wilkinson combiners and splitters. These require either a "star" or a "delta" configuration of resistors between the outlet ports, which can be three or more. However, for high-frequency applications, physically configuring such an arrangement is difficult. At higher frequencies, resistance and impedance effects become complex and difficult. At higher frequencies even small elements can represent a significant portion of a wavelength, so that designing resistors and other elements is difficult.

SUMMARY

In accordance with a first aspect of the present invention, there is provided a resistor assembly, for use at microwave frequencies, the resistor assembly comprising: a) a substrate; b) first and second contacts mounted on the substrate; c) a third contact mounted on the substrate between the first and second contacts; d) first and second resistors mounted on the substrate, the first resistor extending between the first and third contacts, and the second resistor extending between the second and third contacts; and e) a third resistor mounted on the substrate and extending between the first and second contacts, wherein the resistors are maintained spaced from one another by the substrate, wherein the first and second contacts are provided along opposing edges of the substrate, wherein the third contact is provided as a middle contact provided on one side of the substrate and spaced between the first and second contacts, wherein the first and second resistors are provided on said one side of the substrate, and wherein the third resistor is provided on the other side of the substrate.

In accordance with a second aspect of the present invention, there is provided a resistor assembly mounted on a substrate including microstrip connecting lines, the microstrip connecting lines include: a common connection; three line elements connected between the common connection and to the first, second and third contacts, respectively, on one side of the resistor assembly; and, on another side of the resistor assembly, a respective connecting strip connected to each of the first, second and third contacts.

DESCRIPTION OF THE FIGURES

For better understanding of the present invention and to show more clearly how it may be carried into effect, reference now will be made, by way of example to the accompanying drawings which show an embodiment of the invention and in which.

DESCRIPTION

A resistor assembly is generally denoted by the reference 10. The resistor assembly 10 comprises a substrate with wrap around metalizations and thin film resistors connected between the metalizations.

Figure 1:
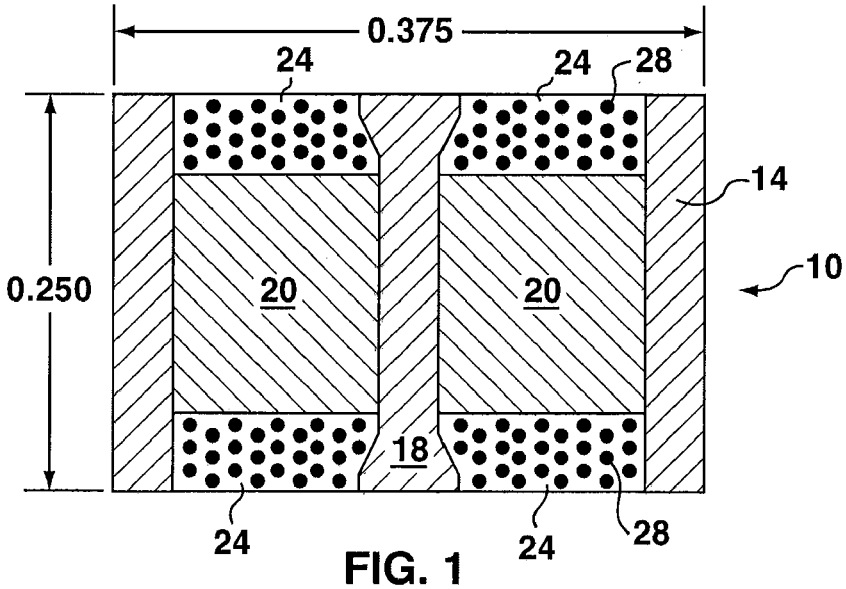
FIG. 1 is a top plan view of a resistor assembly in accordance with the present invention.

More specifically, the resistor assembly 10 may have a substrate 12 formed from a beryllia ceramic and having a 25 thousandth of an inch thickness. This substrate 12 has dimensions of 0.25 inches by 0.375 inches, as indicated in FIG. 1. At either end of the substrate 12, there are metalizations 14 and 16 wrapped around the end of the substrate 12 in known manner. On the top side of the substrate 12, there is an additional intermediate metalization 18, which as shown has a generally constant width in the middle and expanded ends. In known manner, the metalizations 14, 16 and 18 are intended to provide solderable connections, that may be plated or coated with a suitable metal to facilitate soldering.

On the top surface between each of the end metalizations 14, 16 and the central metallization 18, there is a thin film resistor 20, each of these resistors 20 having a resistance of 150 ohms. The resistors 20 provide first and second resistors.

On the bottom surface, there is a single, third thin film resistor 22 extending between the two end metalizations 14, 16, and this is again dimensioned so as to provide a resistance of 150 ohms.

As shown, on the top surface, on either side of the resistors 20, there are portions of the substrate 12 not covered with the resistor material, as indicated at 24. Correspondingly, on the bottom surface, there are exposed portions of the substrate 12 indicated at 26, corresponding to the upper exposed portions 24.

A cover 30 is provided covering the resistor 22 and to insulate it. The cover 30 may be formed from a beryllia ceramic with a 10 thousandths of an inch thickness. The cover 30 is not essential, but may be used in applications where environmental protection is required. In addition the cover 30 may be made of a material with very high thermal conductivity and provide electrical insulation. This will allow attachment to a heat dissipating surface, thus allowing higher temperature dissipation in the resistor. This is essential to withstand power imbalance in the power combining/dividing arms.

Vias 28 are provided through the substrate 12, opening onto the exposed surfaces 24, 26 as indicated at 28. The vias have a heat transfer function, if the resistor material has to made from Alumina, rather than Beryllium or Aluminum Nitride. In such a case the vias have to be solder filled. This will allow maximum heat transfer. For higher frequencies, these vias 28 will likely be necessary to ensure the correct performance. They can be formed by laser drilling. Essentially, for higher or other frequencies, the shape of the resistors can be altered. For example, each of the resistors 20, 22 can show a waisted or hourglass shape.

Figure 4:
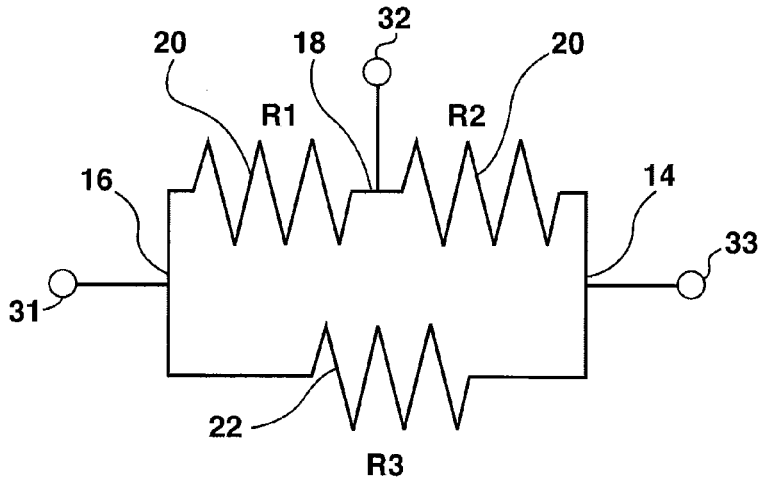
FIG. 4 is a schematic circuit diagram detailing the resistor configuration of the resistor assembly of the present invention.

Referring to FIG. 4, this shows the overall configuration of the resistors. As shown, there is essentially provided a delta configuration where the resistors 20 and 22 are connected between the metalizations 14, 16 and 18 in a delta configuration. As indicated in FIG. 4, this provides for connections to three separate ports 31, 32 and 33.

Figure 2:
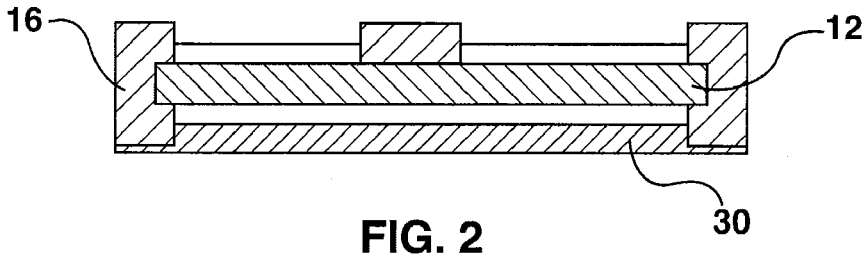
FIG. 2 is a side view of the resistor assembly of FIG. 1.
Figure 3:
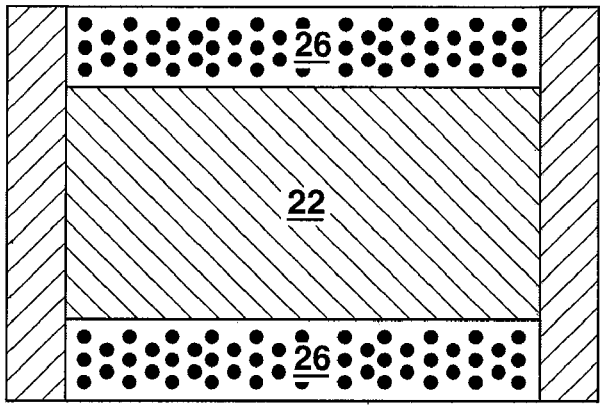
FIG. 3 is a view from the underside of the resistor assembly of the present invention.
Figure 5:
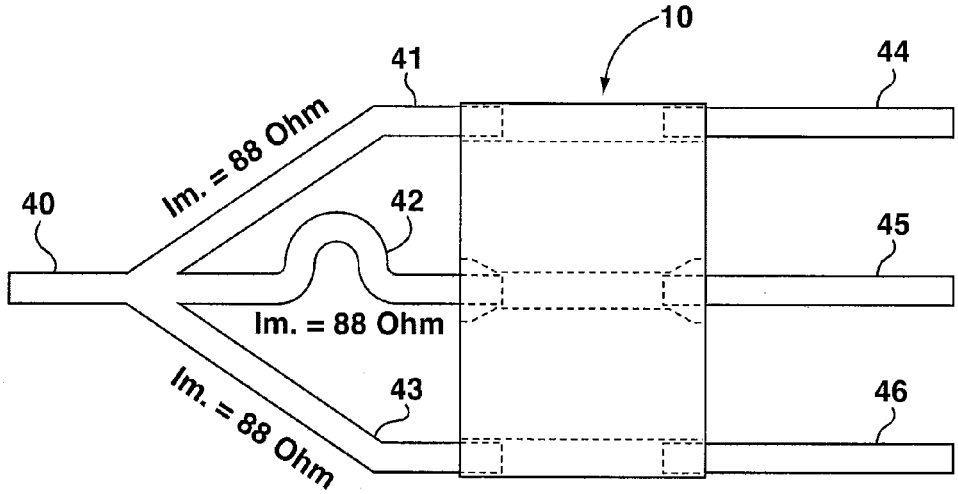
FIG. 5 is a schematic diagram showing mounting of the resistor assembly of the present invention to microstrip.

With reference to FIG. 5, this shows installation of the resistor assembly 10 of the present invention, shown connected to microstrip. It is first to be note that while the elements of the resistor assembly 10 have been described, relative to FIGS. 1, 2 and 3, as having "top" and "bottom" features; as installed in FIG. 5, a "top" of the resistor assembly 10 would be located face down against the microstrip, so that each of the metalizations 14, 16 and 18 can be connected directly to the microstrip. The cover 30, when present, would then be on top of the whole assembly.

FIG. 5 shows on one side a common connection 40 connected to three line elements 41, 42 and 43. Each of these line elements 41, 42 and 43 is configured to have an impedance of 88 ohms, where the resistors 20, 22 each have a resistance of 150 ohms. Note also that the line element 42 is configured to have the same length as the lines elements 41, 42 and 43, e.g. by providing it with a bend; each of these line elements 41, 42 and 43 is provided with a length equal to a quarter of a wave length, in known manner. The impedance of the line elements or ohms 41, 42 and 43 is determined to be $1/\sqrt{3}$ of the impedance of the resistors 20, 22.

On the other side of the resistor assembly 10, there are arms or connecting strips 44, 45 and 46, which can be dimensioned in known manner to provide desired characteristics.

The various connection arms or strips 41-46 are connected to the metalizations 14, 16 and 18 by soldering, in known manner, and as shown in FIG. 5.

This arrangement then enables a three way divider or combiner to be assembled simply and on a conventional substrate.

The invention claimed is:

1. A resistor assembly, for use at microwave frequencies, the resistor assembly comprising:

a) a substrate;

b) first and second contacts mounted on the substrate;

c) a third contact mounted on the substrate between the first and second contacts;

d) first and second resistors mounted on the substrate, the first resistor extending between the first and third contacts, and the second resistor extending between the second and third contacts; and e) a third resistor mounted on the substrate and extending between the first and second contacts, wherein the resistors are maintained spaced from one another by the substrate, wherein the first and second contacts are provided along opposing edges of the substrate, wherein the third contact is provided as a middle contact provided on one side of the substrate and spaced between the first and second contacts, wherein the first and second resistors are provided on said one side of the substrate, and wherein the third resistor is provided on the other side of the substrate.

2. A resistor assembly as claimed in claim 1, including a cover for the third resistor and mounted covering the third resistor and portions of the first and second contacts on the other side of the substrate.

3. A resistor assembly as claimed in claim 1, wherein the substrate comprises beryllia ceramic with a thickness of 25 thou.

4. A resistor assembly as claimed in claim 2, wherein the substrate comprises beryllia ceramic with a thickness of 25 thousandths of an inch and the cover comprises beryllia ceramic with a thickness of 10 thousandths of an inch.

5. A resistor assembly as claimed in claim 1, 2, 3 or 4, wherein the substrate is generally rectangular and each of the resistors is a generally rectangular thin film resistor.

6. A resistor assembly as claimed in claim 5, wherein each of the resistors is inwardly spaced from edges of the substrate to leave portions of the substrate surface exposed, and wherein via holes are provided through the substrate opening onto the exposed portions thereof, to provide required frequency response characteristics.

7. In combination, the resistor assembly of claim 1 and a microstrip, the microstrip comprising:

a common connection;

first, second and third line elements connected between the common connection and the first, third and second contacts of the resistor assembly, respectively; and first, second and third connecting strips arranged on another side of the resistor assembly relative to the line elements, the first, second and third connecting strips connected to the first, third and second contacts of the resistor assembly, respectively.

* * * * *